United States Patent [19]

Nazmy et al.

[11] Patent Number: 4,909,859

[45] Date of Patent: Mar. 20, 1990

[54] PROCESS FOR INCREASING THE OXIDATION RESISTANCE AND CORROSION RESISTANCE OF A COMPONENT MADE OF A DISPERSION STRENGTHENED SUPERALLOY BY A SURFACE TREATMENT

[75] Inventors: Mohamed Nazmy, Fislisbach; Hans Rydstad, Birmenstorf, both of Switzerland

[73] Assignee: BBC Brown, Boveri & Company, Limited, Baden, Switzerland

[21] Appl. No.: 832,899

[22] Filed: Feb. 26, 1986

[30] Foreign Application Priority Data

Mar. 15, 1985 [CH] Switzerland ..... 1166/85

[51] Int. Cl.[4] ..... C21D 1/09

[52] U.S. Cl. ..... 148/11.5 N; 148/11.5 Q; 148/903

[58] Field of Search ..... 148/11.5 N, 11.5 Q, 148/903

[56] References Cited

U.S. PATENT DOCUMENTS 4,015,100 3/1977 Gnanamuthu et al. ..... 148/903

4,531,981 7/1985 Singer ..... 148/11.5 N

*Primary Examiner*—L. Dewayne Rutledge

*Assistant Examiner*—George Wyszomierski

*Attorney, Agent, or Firm*—Oblon, Spivak, McClelland, Maier & Neustadt

[57] ABSTRACT

A process for increasing the oxidation resistance and corrosion resistance of a component made of a dispersion strengthened superalloy by means of a surface treatment, the object of which in every case is to produce or retain a fine-grained surface zone (5) while the core zone (4) of the component in all circumstances is forced to form coarse grains during the final recrystallization annealing in the temperature range between the recrystallization temperature and the solidus temperature. A fine-grained surface zone (5) is produced by cold-working the surface zone (3, 5) by shot-peening, surface milling or pressing or by heating the surface zone (7) to a temperature about 100° to 140° C. below the recrystallization temperature by means of a laser (9) or an arc (10) while the core zone is kept at less than 900° C., or by application of a 10 to 50 μm thick nickel layer onto the surface followed by diffusion of the nickel into the surface zone (nickel-rich surface layer 14) of the component at a temperature below the recrystallization temperature. In each case, recrystallization annealing in order to establish coarse grains in the core zone (4) is finally carried out.

3 Claims, 3 Drawing Sheets

PROCESS FOR INCREASING THE OXIDATION RESISTANCE AND CORROSION RESISTANCE OF A COMPONENT MADE OF A DISPERSION STRENGTHENED SUPERALLOY BY A SURFACE TREATMENT

The invention relates to a process for increasing the oxidation resistance and corrosion resistance of a component made of a dispersion strengthened superalloy, as defined in the preamble of claim 1.

Highly heat-resistant alloys, in particular superalloys, including especially those containing strengthening dispersoids, are always employed under severe conditions wih regard to temperature, mechanical load and corrosive or oxidizing atmosphere. In genral, an attempt is made to increase their oxidation resistance and corrosion resistance by alloying them with suitable elements or by applying protective layers. However, these measures are subject to restrictions. In order to achieve the greatest heat resistance at very high temperatures, these materials are used virtually exclusively in the coarse-grained state, preferably in a state comprising elongated coarse grains (E. Arzt and R. F. Singer, The effect of grain shape on stress rupture of the oxide dispersion strengthened superalloy INCONEL MA 6000, Seven Spring Conference on Superalloys, Conference Proceedings, The Metallurgical Society of AIME, 1984, pages 367–376).

On the other hand, it has been found that fine grained material has a more advantageous behavior with respect to corrosion and oxidation (C. S. Giggins, F. S. Pettit, "The effect of alloy grain size and surface deformation on the selective oxidation of chromium in nickel-chromium alloys at temperatures of 900° and 1100° C.", Trans. TMS-AIME, 245, page 2509, 1969).

In dispersion strengthened alloys, the formation of pores under the material surface was observed after exposure to an oxidizing atmosphere for a certain time. This undesired pore formation depends, inter alia, on the structure, in particular the grain size. Coarse grains promote pore formation, while fine grains inhibit it (J.H. Weber and P.S. Gilman, Environmentally induced porosity in Ni-Cr and Ni-Cr oxide dispersion strengthened alloys, Scripta Metallurgica Vol. 18, pages 479 to 482, 1984; I. K. Glasgow, G. J. Santoro and M. A. Gedwill, "Oxidation & Hot Corrosion of Coated and Bare Oxide Dispersion Strengthened Superalloys", in Frontiers of High Temperature Materials, J. Benjamin ed. Inco. 1981).

In this connection, it has been proposed to produce a component having a coarse-grained core and a fine-grained edge zone (cf. EP-A-0 115,092). However, this possibility has been utilized only to a very limited extent and incompletely.

There is therefore a great need for further possible methods for improving the high temperature stability of components made of superalloys to oxidizing and corrosive effects.

It is the object of the invention to provide a process for increasing the oxidation resistance and corrosion resistance of components made of a dispersion strengthened superalloy by means of a surface treatment, which process does not have an adverse effect on the monolithic cohesion, is distinguishdd by optimum properties of the surface layer and can be carried out economically and in a simple manner on the shaped component.

This object is achieved by the features stated in the characterizing clause of claim 1.

The invention is described with reference to the illustrative examples below, which are explained in more detail by figures.

FIG. 1 shows a schematic micrograph of a section through a component in the state as supplied, with treatment of the surface zone by means of a stream of shot, FIG. 2 shows a schematic micrograph of a section through a component after treatment of the surface zone by shot-peening and after recrystallization annealing, FIG. 3 shows a schematic micrograph of a section through a component on the state as supplied and during the treatment of the surface zone by means of a laser beam or an arc, FIG. 4 shows a graph of the temperature distribution over the workpiece cross-section during heat treatment and during recrystallization annealing, FIG. 5 shows schematic micrograph of a section through a component after treatment of the surface zone by heating with a laser beam or with an arc and after recrystallization annealing, FIG. 6 shows a schematic micrograph of a section through a component in the state as supplied, with an electrolytically applied nickel layer, FIG. 7 shows a schematic micrograph of a section through a component with a nickel layer after a diffusion annealing process, FIG. 8 shows a schematic microraph of a section through a component with a nickel layer after a diffusion annealing process and a recrystallization annealing process, and FIG. 9 shows a schematic micrograph of a section through a component after a diffusion annealing and recrystallization annealing process, after the nickel-rich surface layer has been removed.

FIG. 1 shows schematically a micrograph of a section through a component in the state as supplied during treatment of the surface zone by means of a stream of shot. 1 is the medium-grained to fine-grained structure of the workpiece in a state as supplied (eg. extruded, rolled or fogged product). Here, the grain size is generally not very critical. However, the structure must possess sufficient motive force to form coarse grains after the final recrystallization annealing. 2 is a stream of shot which is used for cold-working the surface, whereas 3 represents that surface zone of the workpiece which has already been deformed by shot-peening. The direction of displacement of the stream of shot 2 is indicated by means of an arrow.

FIG. 2 represents a schematic micrograph of a section through a component treated according to FIG. 1, ie. after the treatment of the surface zone by shot-peening and after an additional recrystallization annealing. 4 represents the coarse-grained recrystallized core zone and 5 represents the fine-grained recrystallized surface zone which has been deformed beforehand.

FIG. 3. shows schematically a micrograph of a section through a component in the state as supplied and during thermal treatment of the surface zone. In general, the workpiece has a fine-grained structure. The core zone 6 is kept at a lower temperature during the treatment, while the surface zone 7 is heated to a higher temperature. This is done using either a laser beam 9 (as indicated by $h\nu$ in the left-hand half of the figure) or an electric arc 10 (as indicated by current I in the right-hand half of the figure). The direction of displacement of 9 or 10 is indicated by an arrow in each case. 8 represents the surface of the workpiece.

FIG. 4 shows a graph of the temperature distribution over the workpiece cross-section (abscissa x) during the heat treatment according to FIG. 3 and during the recrystallization annealing. Curve a represents the variation of the heat-treatment temperature over the wokpiece cross-section. In the actual core zone 6, the temperature should be kept comparatively low, in the present case below 900° C. The surface zone 7 should be heated to a temperature which is still below the recrystallization temperature, for example to 1140° C. The lateral limits of the component are indicated by the vertical workpiece surface 8. Curve b represents the variation of the recrystallization temperature over the work-piece cross-section, which is in general a horizontal line.

Figure 8:
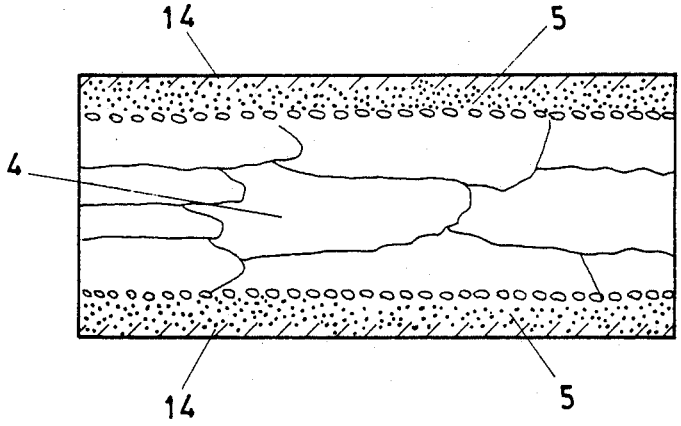

FIG. 8 shows schematically a micrograph of a section through a component with a nickel layer after a diffusion annealing process and a recrystallization annealing process. On top of the coarse-grained recrystallized core zone 4 is located first the fine-grained recrystallized surface zone 5 and finally the actual nickel-rich surface layer 14, which, at the workpiece surface, may in certain circumstances also consist of pure nickel.

Figure 9:
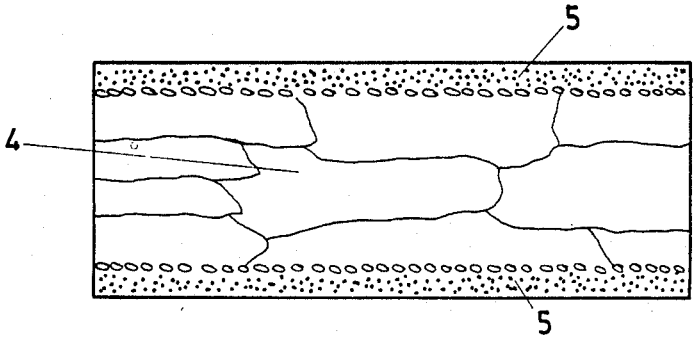

FIG. 9 shows a schematic micrograph of a section through a component after a diffusing annealing and recrystallization annealing process according to FIG. 8, after the nickel-rich surface layer 14 has also been removed. The remaining reference symbols correspond to those of FIG. 8.

Figure 1:
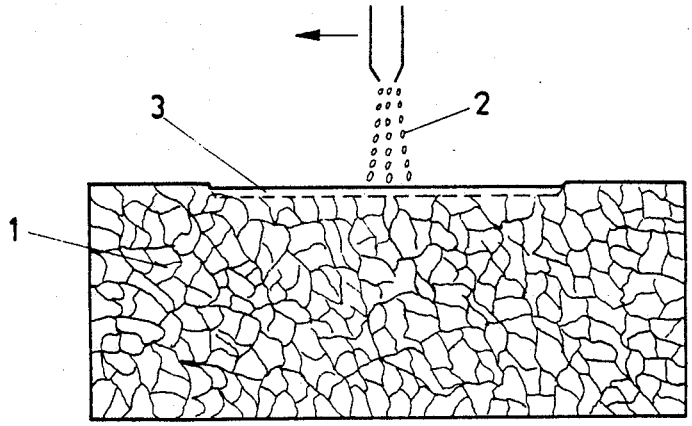
Figure 2:
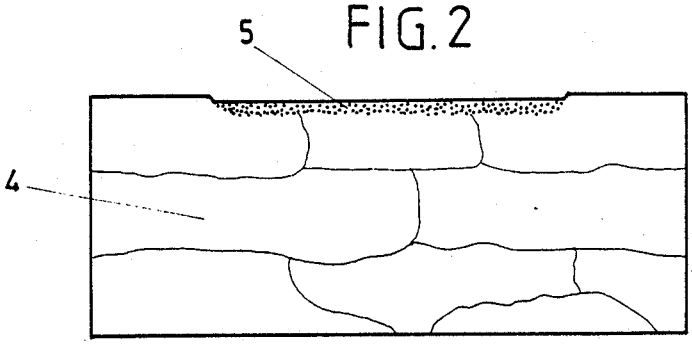

ILLUSTRATIVE EXAMPLE I:

See FIGS. 1 and 2

A prismatic specimen 100 mm long, 40 mm wide and 40 mm thick was cut from a forged ingot having medium sized grains and made of a dispersion strengthened nickel-based superalloy. The alloy, known under the tradename MA 6000 (INCO), had the following composition:

| | |
|---|---|
| Ni ≈ | 69% by weight |
| Cr = | 15% by weight |
| W = | 4.0% by weight |
| Mo = | 2.0% by weight |
| Al = | 4.5% by weight |
| Ti = | 2.5% by weight |
| Ta = | 2.0% by weight |
| C = | 0.05% by weight |

-continued

| | |
|---|---|
| B = | 0.01% by weight |
| Zr = | 0.15% by weight |
| $Y_2O_3$ = | 1.1% by weight |

The surface zone 3 of a longitudinal side of the prismatic specimen was deformed by means of a stream of shot 2 over its entire width and over a length of 60 mm. The pressure during shot-peening was 0.8 MPa, the diameter of the steel shot was 0.3 to 0.6 mm, and the total peening time for the entire area was 5 minutes. After the shot-peening, the specimen was anneale for 1 hour at a temperature of 1280° C. The coarse-grained recrystallized core zone 4 possessed crystallites elongated in the form of stems and having a length of 12 to 15 mm and a width of 4 to 6 mm, while the 200 μm deep fine-grained recrystallized surface zone 5 had a mean grain size of less than 2 μm.

Fine-grained surface zones 5 about 100 to 200 μm thick can be prepared in the manner described. The operating parameters for the shot-peening vary depending on the alloy to be treated, the structural state of the starting material nd the thickness of the fine-grained surface zone to be prepared.

ILLUSTRATIVE EXAMPLE II:

A rectangular piece measuring 4×100×30 mm was cut out from a fine-grained sheet made of a dispersion strengthened nickel-based superalloy. The material, available under the tradename MA 754 (INCO), had the following composition:

| | |
|---|---|
| Ni ≈ | 78% by weight |
| Cr = | 20% by weight |
| C = | 0.05% by weight |
| Al = | 0.3% by weight |
| Ti = | 0.5% by weight |
| Fe = | 1.0% by weight |
| $Y_2O_3$ = | 1.0% by weight |

The section of sheet was subjected to a single cold-rolling process, the thickness being reduced in total from an initial value of 4 mm to 3.9 mm (2.5%). This cold deformation took place predominantly in the surface zones of the sheet. After cold-rolling had been carried out, the section of sheet was subjected to recrystallization annealing for ½ hour at a temperature of 1330° C. The coarse-grained recrystallized core zone exhibited elongated crystallites which on average were 6 to 8 mm long, 2 mm wide and 1 mm thick, while the 150 μm deep fine-grained recrystallized surface zones had grain sizes of 2 to 5 μm.

The degree of cold deformation during milling, rolling, pressing, etc. can advantageously be set so that it corresponds to a reduction in thickness of about 2 to 5% for such sheet-like, band-like and panel-like workpieces.

Figure 3:
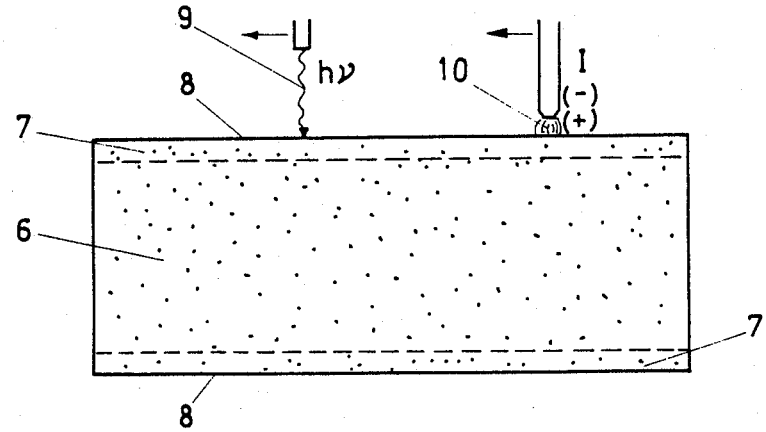
Figure 4:
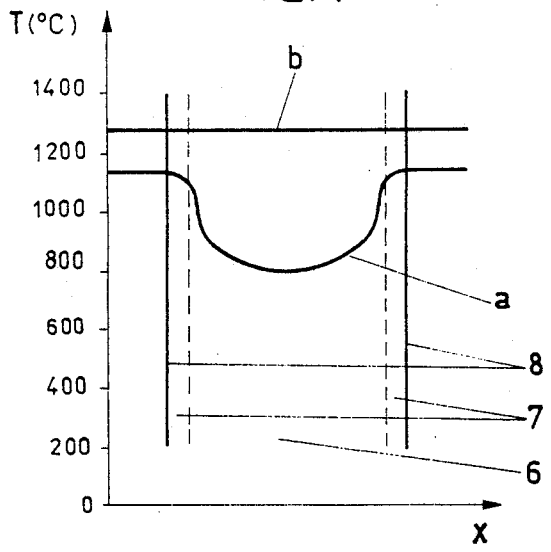
Figure 5:
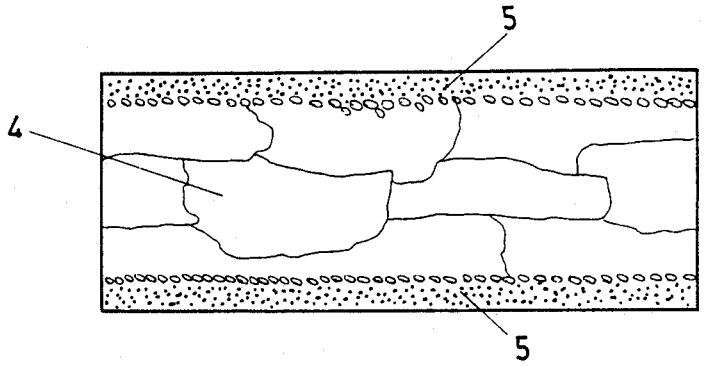
FIG. 5 represent a schematic micrograph of a section through a component after treatment of the surface zone according to FIG. 3, ie after heating by means of a laser beam or arc and after the recrystallization annealing. The fine-grained recrystallized surface zone 5 is clearly distinguished from the coarse-grained recrystallized core zone 4.
Figure 6:
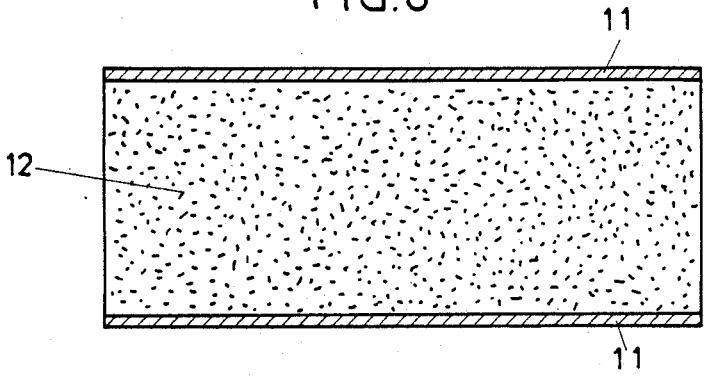
FIG. 6 shows schematically a micrograph of a section through a component in the state as supplied, with an electrolytically applied nickel layer. 12 is the fine-grained material structure in the state as supplied. 11 is the electrolytically applied nickel layer, shown in greatly exaggerated thickness.
Figure 7:
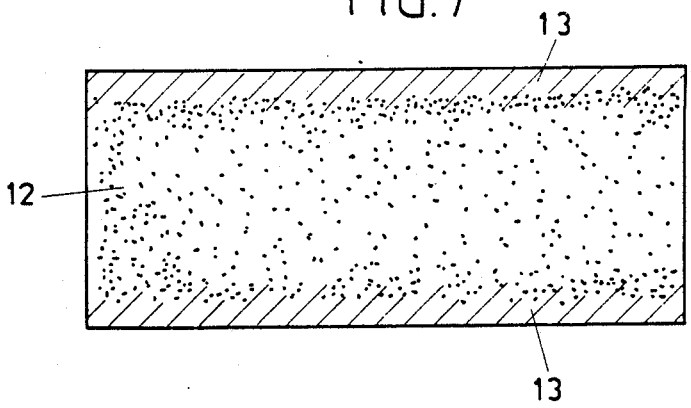
FIG. 7 shows a schematic micrograph of a section through a component with a nickel layer after the diffusion annealing. 12 is the unchanged fine-grained material structure, and 13s the surface zone of the workpiece, this zone having been enriched with nickel by diffusion.

ILLUSTRATIVE EXAMPLE III:

Cf. FIG. 3, left-hand side, and FIGS. 4 and 5.

A 100 mm workpiece was sawn off from a circular rod having a diameter of 40 mm and produced by hot extrusion. The material was the nickel-based superalloy state in Example 1, with the tradename MA 6000. The surface 8 (cylindrical surface) of the workpiece was exposed to a laser beam 9 for 10 minutes so that a temperature distribution according to curve a, FIG. 4, was finally established. The core zone 6, which is at a lower temperature (about 800° to 1000° C., on average about 900° C.), is clearly distinguished from the surface zone 7, which is at a higher temperature (not more than about 1140° C.). To avoid a harmful temperature equilibration, the workpiece was cooled rapidly to room temperature after this heat treatment. The subsequent recrystalliaation annealing at a temperature of 1280° C. (curve b in FIG. 4) gave the picture shown in FIG. 5.

ILLUSTRATIVE EXAMPLE IV:

Cf. FIG. 3, right-hand side, and FIGS. 4 and 5.

A workpiece having the same dimensions and composition as those stated in Example III was exposed to an electric arc 10 for 15 minutes. The intensity of the arc and the displacement were adjusted so that the temperature profile shown in FIG. 4 was approximately achieved. The recrystallization annealing at a temperature of 1280° C. gave the same results as under Example III.

The values stated in Examples III and IV for the heat treatment of the surface zone can easily be varied, depending on the dimensions of the workpiece and the intensity of the energy source. For the stated alloy, the temperature should be in the range from 1140° to 1150° C. and the duration about 10 to 30 minutes.

ILLUSTRATIVE EXAMPLE V:

Cf. FIGS. 6, 7, 8 and 9

A turbine blade was produced from the material having the name MA 6000 (workpiece structure 12 in the fine-grained state). The blade, designed as an airfoil, had a length of 220 mm, a width of 70 mm and a profile depth of 18 mm, with a maximum thickness of 12 mm. The component was first cleaned, degreased and then suspended in an electrochemical nickel bath. A 50 μm thick nickel layer 11 was applied onto the surface by electroplating. The workpiece was then subjected to diffusion annealing under a protective gas atmosphere at a temperature of 1020° C. for 6 hours. During this procedure, the nickel-enriched surface zone 13 was formed. The diffusion of nickel into the base material caused a certain degree of grain growth, which can be influenced by the thickness of the nickel layer, the diffusion temperature and the diffusion time. In the present case, the diffusion layer reached an average thickness of 200 μm. The consequence of the controlled grain growth during the diffusion process was that the recrystallization annealing carried out subsequently according to Example I a 1280° C. for 1 hour gave a coarse-grained recrystallized core zone 4, while a fine-grained surface zone 5 was obtained. A thin, unchanged nickel-rich surface layer 14 still remained as an outermost zone. This surface layer 14 was finally removed by an electrolytic method (see FIG. 9).

Nickel layers 11 can advantageously have a thickness of 10 to 50 μm. The diffusion annealing for the material MA 6000 can be carried out at temperatures between about 1000° and 1050° C. for about 4 to 10 hours.

The invention is not restricted to the illustrative examples.

The cold-working of the surface can be effected not only by shot-peening, surface milling and pressing, but also by drawing or opening out (in the case of hollow articles) or in any other manner known per se. Recrystallization annealing must be carrie out in the range between the recrystallization temperature and the solidus temperature.

During the surface treatment by heating the surface zone, this temperature should be about 100° to 140° C. below the recrystallization temperature, while the actual core zone to be caused to undergo coarse-grain recrystallization should be kept as cold as possible, an in any case below 900° C.

We claim:

1. A process for increasing the oxidation resistance and corrosion resistance of a component made of a dispersion strengthened superalloy, by a surface treatment, which comprises:

(a) heating a fine-grained structural component material having a layer of nickel thereon, which component has first been hot-worked, to a temperature below the recrystallization temperature of the material, thereby effecting diffusion of nickel into the component interior to produce a surface zone having an enhanced concentration of nickel therein, and a core zone below said surface zone which is not nickel-enhanced;

(b) cooling said component; and (c) heating said component to a temperature above the recrystallization temperature, whereby the core zone forms coarse grains, and said surface zone is prevented by lack of motive force from undergoing secondary recrystallization, thereby retaining a fine-grained structure.

2. The process as claimed in claim 1, wherein said nickel layer is about 10–50 μm thick and is applied by electroplating.

3. The process according to claim 1, wherein said nickel diffuses into said structural component to a depth of about 200 μm, said diffusion being effected at a temperature of about 1000°–1050° C. for a period of about 4 to 10 hours.

* * * * *